US007604096B2

(12) United States Patent
Kawai

(10) Patent No.: US 7,604,096 B2
(45) Date of Patent: Oct. 20, 2009

(54) OPERATION DEVICE FOR ELEVATOR

(75) Inventor: Kiyoji Kawai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 441 days.

(21) Appl. No.: 11/572,994

(22) PCT Filed: Apr. 19, 2005

(86) PCT No.: PCT/JP2005/007454

§ 371 (c)(1),
(2), (4) Date: Jan. 31, 2007

(87) PCT Pub. No.: WO2006/114866

PCT Pub. Date: Nov. 2, 2006

(65) Prior Publication Data

US 2009/0038890 A1 Feb. 12, 2009

(51) Int. Cl.
*B66B 1/34* (2006.01)

(52) U.S. Cl. ..... 187/393; 187/901; 297/14

(58) Field of Classification Search ..... 187/200, 187/277, 391–393, 414, 901; 297/1–3, 14, 297/118, 123

See application file for complete search history.

(56) References Cited

U.S. PATENT DOCUMENTS

| | | | | |
|---|---|---|---|---|
| 6,089,651 | A * | 7/2000 | Carmen | 297/16.1 |
| 6,244,662 | B1 * | 6/2001 | Porcheron | 297/383 |
| 6,896,322 | B1 * | 5/2005 | Foy | 297/14 |

FOREIGN PATENT DOCUMENTS

| | | | |
|---|---|---|---|
| JP | 53 149363 | | 11/1978 |
| JP | 9 315738 | | 12/1997 |
| JP | 2000041780 | * | 2/2000 |
| JP | 2001178591 | * | 7/2001 |
| JP | 2001 245751 | | 9/2001 |
| JP | 2002 60169 | | 2/2002 |

(Continued)

OTHER PUBLICATIONS

References AO-AR have been cited in the International Search Report.

(Continued)

*Primary Examiner*—Jonathan Salata
(74) *Attorney, Agent, or Firm*—Oblon, Spivak, McClelland, Maier & Neustadt, L.L.P.

(57) ABSTRACT

An operating apparatus for an elevator is equipped with a landing chair having a storable seat portion and provided at a landing, a landing chair displacement device for displacing the seat portion, and a control device for controlling the landing chair displacement device. The seat portion can be displaced between a landing chair storage position and a landing chair service position allowing a passenger to sit. The landing chair displacement device performs a storage execution operation of displacing the seat portion from the landing chair service position to the landing chair storage position to hold the seat portion at the landing chair storage position, and a storage releasing operation of releasing the seat portion from being held at the landing chair storage position. The control device has landing chair control means for controlling the landing chair displacement device based on information from operation detecting means for detecting an operational state of the elevator.

15 Claims, 7 Drawing Sheets

FOREIGN PATENT DOCUMENTS

| | | | | |
|---|---|---|---|---|
| JP | 2002060169 | A | * | 2/2002 |
| JP | 2002 209672 | | | 7/2002 |
| JP | 2003310389 | A | * | 11/2003 |
| JP | 2003339473 | A | * | 12/2003 |

OTHER PUBLICATIONS

References have been cited in the corresponding Search Report.
References are discussed in the specification.
References AS is additional prior art known to Applicant.

* cited by examiner

OPERATION DEVICE FOR ELEVATOR

TECHNICAL FIELD

The present invention relates to an operating apparatus for an elevator having a structure in which a storable chair is provided at a landing.

BACKGROUND ART

In a conventional elevator, a storable chair may be provided within a car. The chair is automatically ejected by operating a predetermined button within the car. Thus, a passenger can sit on the chair within the car and rest his/her body. The ejected chair is automatically stored after the car has reached a destination floor and a car door has closed (see Patent Document 1).

Patent Document 1: JP 09-315738 A

DISCLOSURE OF THE INVENTION

Problem to be solved by the Invention

In the conventional elevator constructed as described, above, however, the chair is mounted only within the car, so the passenger can use the chair within the car but cannot use a chair while waiting for the car at a landing.

If a chair is installed at the landing, there is an apprehension that the chair may constitute an obstacle.

The present invention has been made to solve the above-mentioned problem, and it is therefore an object of the present invention to obtain an operating apparatus for an elevator which allows a passenger to sit on a chair while waiting at a landing and can prevent the chair from constituting an obstacle at the landing.

Means for solving the Problems

An operating apparatus for an elevator according to the present invention includes: a landing chair provided at a landing and having a seat portion displaceable between a landing chair storage position and a landing chair service position allowing a passenger to sit; a landing chair displacement device for performing a storage execution operation of displacing the seat portion from the landing chair service position to the landing chair storage position to hold the seat portion at the landing chair storage position, and a storage releasing operation of releasing the seat portion from being held at the landing chair storage position; and a control device having landing chair control means for controlling the landing chair displacement device based on information from operation detecting means for detecting an operational state of the elevator.

BEST MODE FOR CARRYING OUT THE INVENTION

A preferred embodiment of the present invention will be described hereinafter with reference to the drawings.

EMBODIMENT 1

Figure 1:
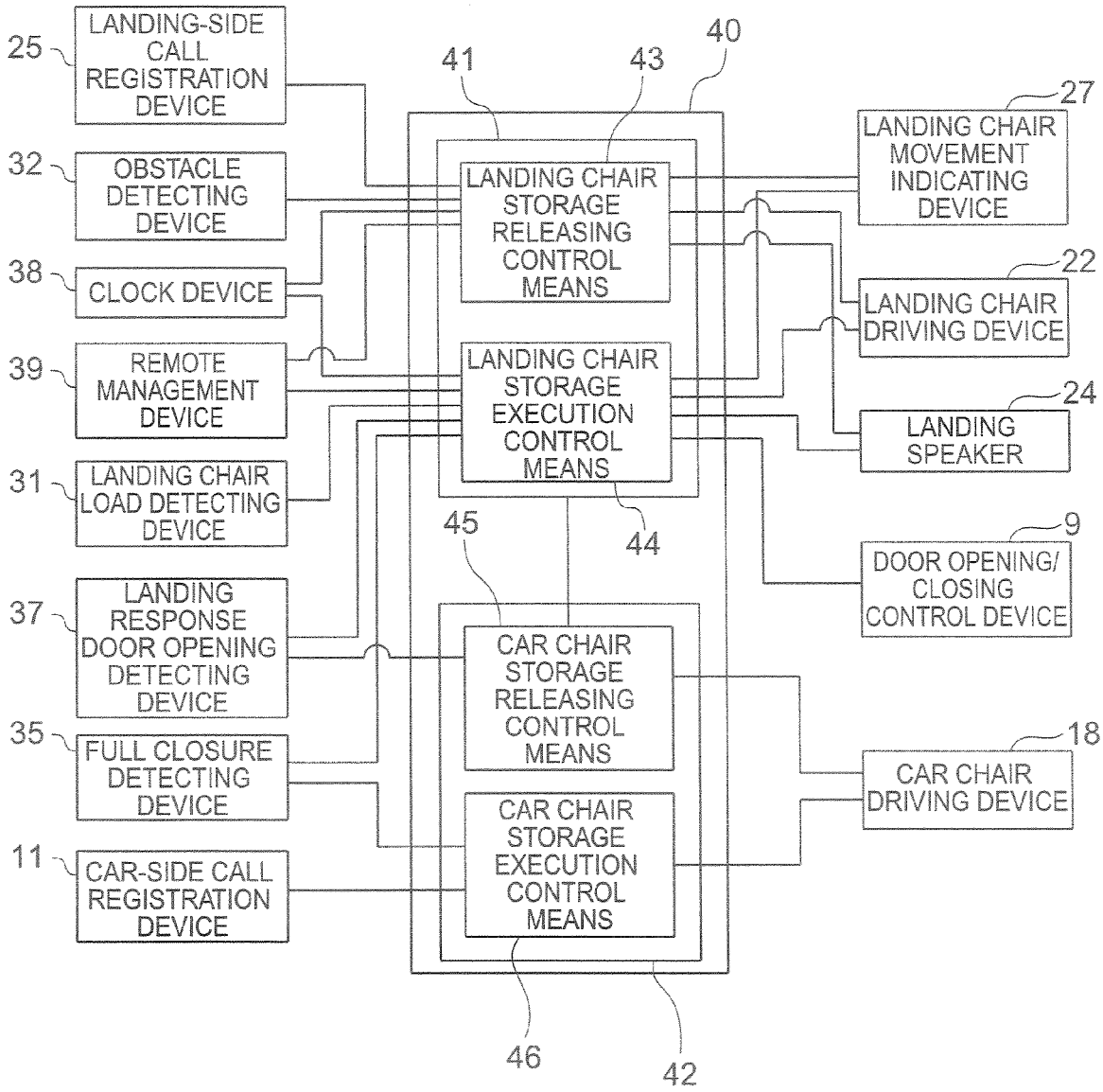
FIG. 1 is a block diagram snowing an operating apparatus for an elevator according to Embodiment 1 of the present invention.
Figure 2:
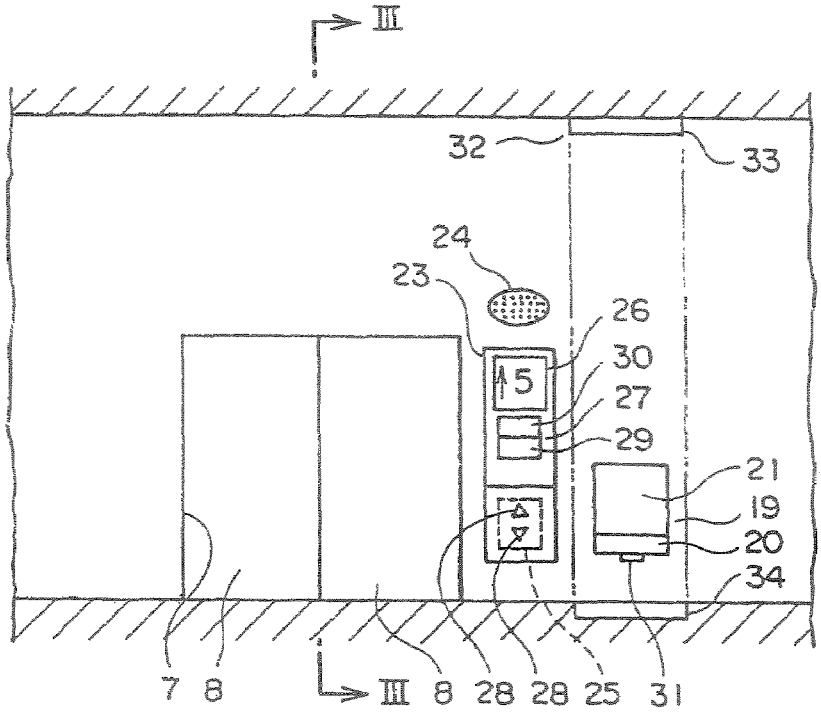
FIG. 2 is a front view showing an elevator doorway provided with the operating apparatus for the elevator of FIG. 1.
Figure 3:
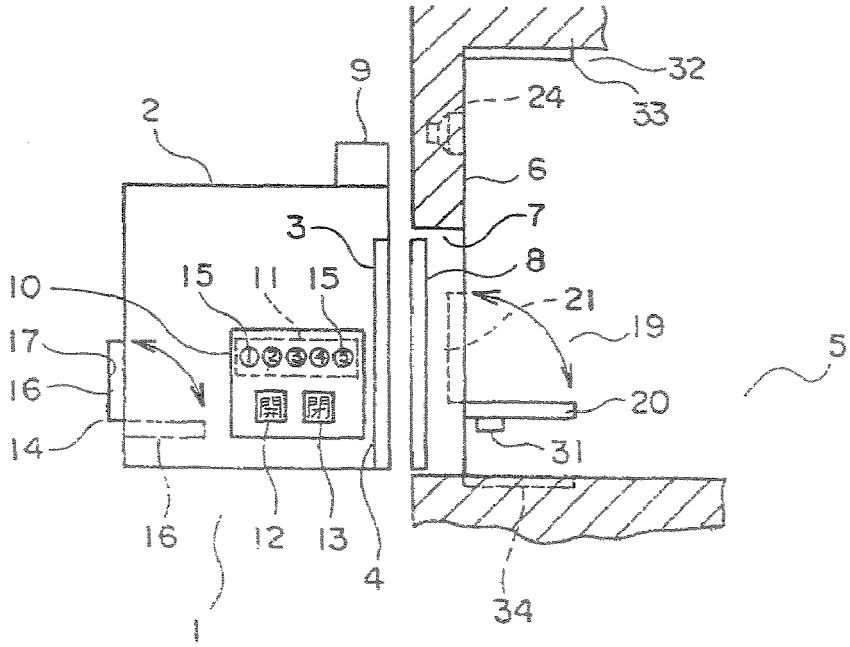
FIG. 3 is a cross-sectional view taken along the line III-III of FIG. 2.

FIG. 1 is a block diagram showing an operating apparatus for an elevator according to Embodiment 1 of the present Invention. FIG. 2 is a front view showing an elevator doorway provided with the operating apparatus for the elevator of FIG. 1. Further, FIG. 3 is a cross-sectional view taken along the line III-III of FIG. 2. In the figures, a car 2, which is raised/lowered within a hoistway 1, is provided with a car doorway 3 (FIG. 3). The car doorway 3 is opened/closed by a pair of car doors 4. A landing 5 is provided with a landing wall 6, which is provided with a landing doorway 7 through which the hoistway 1 and the landing 5 communicate with each other. The landing doorway 7 is opened/closed by a pair of landing doors 8. The car 2 is mounted with a door driving device (not shown). When the car 2 is on a floor of the landing 5, the car doorway 3 and the landing doorway 7 are engaged with each other by an engagement device (not shown) and can be displaced integrally due to a driving force of the door driving device.

An elevator doorway, through which the landing 5 and the interior of the car 2 communicate with each other, has the car doorway 3 and the landing doorway 7. An elevator door for opening/closing the elevator doorway has the respective car doors 4 and the respective landing doors 8. That is, the elevator door is displaced due to a driving force of the door driving device, and the elevator doorway is opened/closed by the elevator door. In this example, the elevator is provided in a five-story building on the ground.

The car 2 is mounted with a door opening/closing control device 9 for controlling the opening/closing operations of the elevator doorway (FIG. 3). A car operator control panel 10 is provided within the car 2. The car operator control panel 10 is provided with a car-side call registration device 11 for performing a call registration of the car 2, a door opening button 12 and a door closing button 13 operated within the car 2 to perform a door opening operation and a door closing operation of the elevator doorway, respectively. In addition, a storable car chair 14 is provided on an inner wall of the car 2.

The car-side call registration device 11 has a plurality of (five corresponding to first to fifth floors, respectively, in this example) destination floor buttons 15, which are operated within the car 2. Each of the destination floor buttons 15 is operated to register a call for the car 2 to a corresponding one of the destination floors.

The car chair 14 has a seat portion 16, which can turn around a horizontal shaft provided on the inner wail of the car 2. A storage portion 17 for storing the seat portion 16 is provided in the inner wall of the car 2. The seat portion 16 can turn between a car chair storage position (solid line of FIG. 3) allowing the seat portion 16 to be stored in the storage portion 17 and a car chair service posit ion (double-dashed broken line of FIG. 3) allowing the seat portion 16 to eject from the storage portion 17 to the interior of the car 2 in order for a passenger within the car 2 to sit on the seat portion 16.

A car chair driving device (seat portion displacement device) 18 (FIG. 1) for turning the seat portion 16 between the car chair storage position and the car chair service position is provided on the inner wall of the car 2. That is, the car chair driving device 18 performs a storage execution operation of releasing the seat portion 16 from being held at the car chair service position and turning the seat portion 16 to the car chair storage position, and a storage releasing operation of releasing the seat portion 16 from being held at the car chair storage position and turning the seat portion 16 to the car chair service position.

The landing 5 is provided with a storable landing chair 19. The landing chair 19 has a seat portion 20, which can turn around a horizontal shaft provided on the landing wall 6. A storage portion 21 in which the seat portion 20 is stored is provided in the landing wall 6. The seat portion 20 can turn between a landing chair storage position (double-dashed broken line of FIG. 2) allowing the seat portion 20 to be stored in the storage portion 21, and a landing chair service position (solid line of FIG. 2) allowing the seat portion 20 to be ejected from the storage portion 21 to the landing 5 side in order for a passenger at the landing 5 to sit on the seat portion 20.

A landing chair driving device (seat portion displacement device) 22 (FIG. 1) for turning the seat portion 20 between the landing chair storage position and the landing chair service position is provided on the landing wall 6. That is, the landing chair driving device 22 performs a storage execution operation of releasing the seat portion 20 from being held at the landing chair service position and turning the seat portion 20 to the landing chair storage position, and a storage releasing operation of releasing the seat portion 20 from being held at the landing chair storage position and turning the seat portion 20 to the landing chair service position.

A landing operator control panel 23 and a landing speaker (notification device) 24 are provided on a region of the landing wall 6 between the seat portion 20 and the landing doorway 7. The landing operator control panel 23 is provided with a landing-side call registration device 25 for registering a call for the car 2, a car travel indicating device 26 for indicating a position and a moving direction of the car 2, and a landing chair movement indicating device (notification device) 27 for notifying the landing 5 that the seat portion 20 of the landing chair 19 is turned (displaced).

The landing-side call registration device 25 has a pair of landing operational buttons 28 operated at the landing 5. Each of the landing operational buttons 28 is operated to register a call for the car 2 at the landing 5. The landing chair movement indicating device 27 has a storage execution alarm lamp 29 that is lit when the landing chair driving device 22 performs the storage execution operation, and a storage releasing alarm lamp 30 that is lit when the landing chair driving device 22 performs the storage releasing operation. The landing speaker 24 notifies by a sound the landing 5 that the seat portion 20 of the landing chair 19 is turned (displaced).

The seat portion 20 of the landing chair 19 is provided with a landing chair load detecting device 31 for detecting whether or not there is a passenger sitting on the seat portion 20. The landing 5 is provided with an obstacle detecting device 32 for detecting whether or not there is an obstacle within a range in which the seat portion 20 is turned. In this example, the obstacle detecting device 32 is designed as a light projecting/receiving optical sensor. That is, the obstacle detecting device 32 has a light projecting portion 33 provided on one of a ceiling portion and a floor portion of the landing 5, and a light receiving portion 34 provided on the other of the ceiling portion and the floor portion to receive light from the light projecting portion 33. The obstacle detecting device 32 detects whether or not there is an obstacle, depending on whether or not the light receiving portion 34 has received light from the light projecting portion 33.

The elevator doorway is provided with a full closure detecting device 35 for detecting whether or not the door closing operation has been completed (FIG. 1). A control panel (not shown) is provided within the hoistway 1. The control panel is mounted with a landing response door opening detecting device 37 for detecting that the car 2 has reached the floor of the landing 5 in response to a call for the car 2 registered by the landing-side call registration device 25 and the door opening operation has been started, and a clock device 38 in which a predetermined time zone is set. In a case where, for example, the building in which the elevator is provided is an office building, a busy time zone or the like (clock-in time zone or clock-out time zone) in which many people use the elevator can be mentioned as the predetermined time zone set in the clock device 38. In addition, a central supervisory room (not shown) is provided in the building. A remote management device 39 for remotely managing the operation of the elevator is provided in the central supervisory room.

The control panel is mounted with a control device 40 for controlling the operation of the elevator. The control device 40 has landing chair control means 41 for performing control when the seat portion 20 of the landing chair 19 is turned (displaced), and car chair control means 42 for performing control when the seat portion 16 of the car chair 14 is turned (displaced).

The landing chair control means 41 has landing chair storage releasing control means 43 for performing control when the seat portion 20 is turned (displaced) from the landing chair storage position to the landing chair service position, and landing chair storage execution control means 44 for performing control when the seat portion 20 is turned from the landing chair service position to the landing chair storage position. The car chair control means 42 has car chair storage releasing control means 45 for performing control when the seat portion 16 is turned from the car chair storage position to the car chair service position, and car chair storage execution control means 46 for performing control when the seat portion 16 is turned from the car chair service position to the car chair storage position (FIG. 1).

Pieces of information are input to the landing chair storage releasing control means 43 from the landing-side call registration device 25, the obstacle detecting device 32, the clock device 38, and the remote management device 39 respectively. Pieces of information are input to the landing chair storage execution control means 44 from the landing chair load detecting device 31, the full closure detecting device 35, the landing response door opening detecting device 37, the clock device 38, and the remote management device 39 respectively.

The landing chair storage releasing control means 43 controls the landing chair driving device 22 such that the storage releasing operation is performed at least on the condition that a call for the car 2 has been registered by the landing-side call registration device 25. The landing chair storage releasing control means 43 controls the landing chair driving device 22 such that the storage releasing operation is prevented from being started at least either when the obstacle detecting device 32 detects an obstacle or when the elevator is operated in the predetermined time zone set in the clock device 38.

The landing chair storage execution control means 44 controls the landing chair driving device 22 such that the storage execution operation is performed at least on the condition that the car 2 has reached the floor of the landing 5 in response to a call for the car 2 registered by the landing-side call registration device 25 and the door closing operation of the elevator doorway at the landing 5 has been completed. The landing chair storage execution control means 44 outputs a door open state maintaining command to the door opening/closing control device 9 such that the door closing operation of the elevator doorway is prevented from being started when the landing chair load detecting device 31 detects that the elevator doorway at the landing 5 is in a door open state and that there is a passenger sitting on the seat portion 20.

The landing chair control means 41 notifies the landing 5, through the landing speaker 24 and the landing chair movement indicating device 27, respectively, that the seat portion 20 is turned (displaced), when the landing chair driving device 22 performs each of the storage execution operation and the storage releasing operation. The landing chair control means 41 also controls the landing chair driving device 22 such that the storage execution operation and the storage releasing operation are performed based on information from the remote management device 39.

Pieces of information are input to the car chair storage releasing control means 45 from the landing chair control means 41 and the landing response door opening detecting device 37 respectively. Respective pieces of information in the car-side call registration device 11 and the full closure detecting device 35 are input to the car chair storage execution control means 46.

The car chair storage releasing control means 45 controls the car chair driving device 18 such that the storage releasing operation is performed at least on the condition that the storage releasing operation of the landing chair driving device 22 has been completed, the car 2 has responded to a call registered by the landing-side call registration device 25, and the door opening operation of the elevator doorway has been started. The car chair storage execution control means 46 controls the car chair driving device 18 such that the storage execution operation is performed on the condition that the door closing operation of the elevator doorway has been completed in response to all the calls registered by the car-side call registration device 11.

Operation detecting means for detecting an operational state of the elevator has the car-side call registration device 11, the landing-side call registration device 25, the full closure detecting device 35, and the landing response door opening detecting device 37.

Next, an operation will be described. The seat portion 16 is usually disposed at the car chair storage position, and the seat portion 20 is usually disposed at the landing chair storage position. The car chair control means 42 controls the operation during displacement of the seat portion 16, and the landing chair control means 41 controls the operation during displacement of the seat portion 20.

Figure 4:
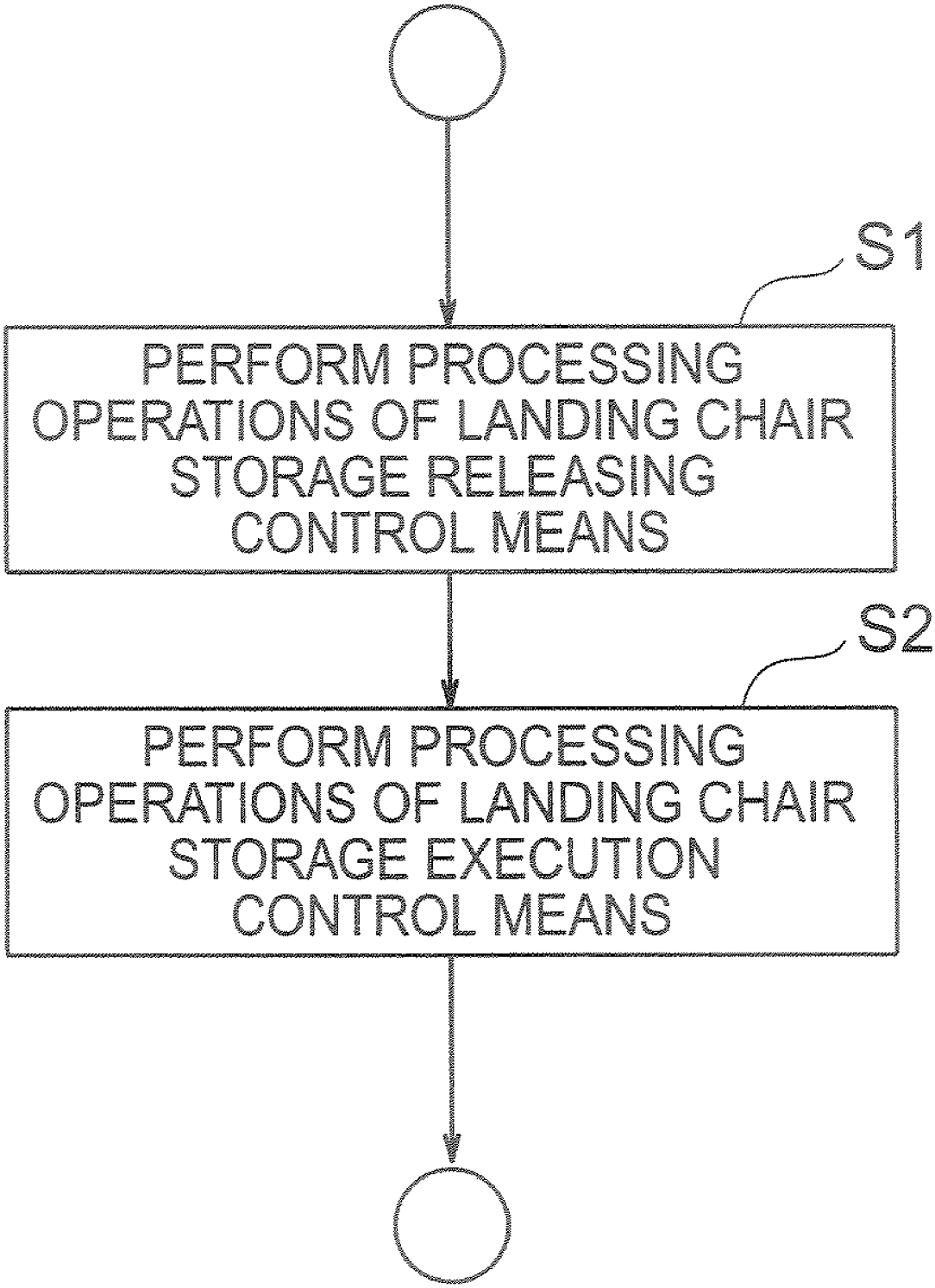
FIG. 4 is a flowchart showing processing operations of the landing chair control means of FIG. 1.

FIG. 4 is a flowchart showing processing operations of the landing chair control means 41 of FIG. 1. As shown in the figure, the landing chair control means 41 first performs processing operations by the landing chair storage releasing control means 43 (S1), and then performs processing operations by the landing chair storage execution control means 44 (S2).

Figure 5:
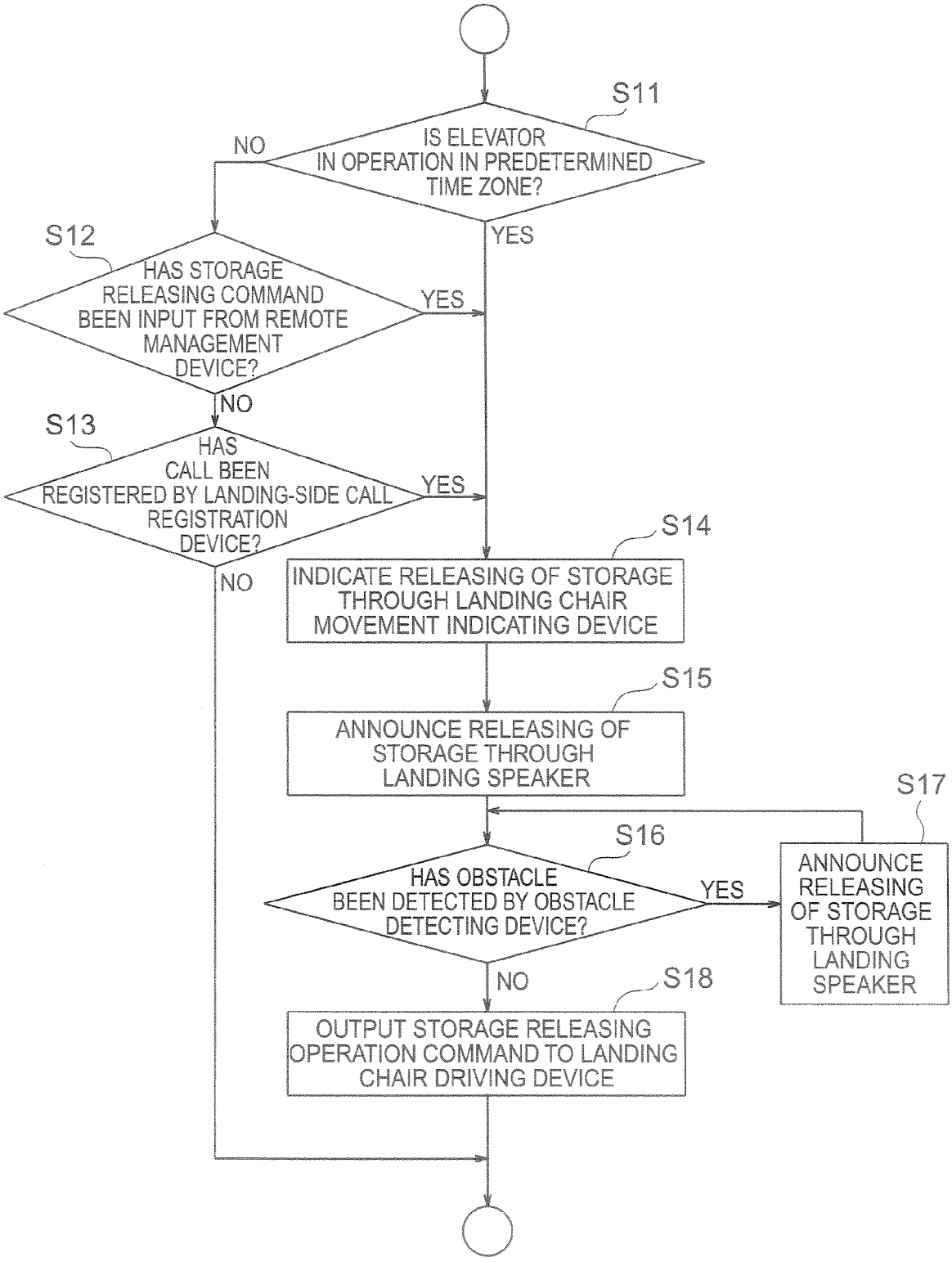
FIG. 5 is a flowchart showing the processing operations of the landing chair storage releasing control means of FIG. 1.

Next, processing operations of the landing chair storage releasing control means 43 will be described. FIG. 5 is a flowchart showing the processing operations of the landing chair storage releasing control means 43 of FIG. 1. As shown in the figure, the landing chair storage releasing control means 43 first determines based on information from the clock device 38 whether or not a time zone in which the elevator is in operation corresponds to the predetermined time zone (i.e., busy time zone) (S11). When the time zone in which the elevator is in operation does not correspond to the predetermined time zone, the landing chair storage releasing control means 43 determines whether or not a storage releasing command from the remote management device 39 has been input to the landing chair control means 41 (S12). When the storage releasing command is not input, the landing chair storage releasing control means 43 determines whether or not a call has been registered by the landing-side call registration device 25 (S13). When no call has been registered by the landing-side call registration device 25, the landing chair driving device 22 is not operated, thereby maintaining the seat portion 20 to be held at the landing chair storage position.

When the time zone in which the elevator is in operation corresponds to the predetermined time zone, when the storage releasing command from the remote management device 39 is input, or when a call is registered by the landing-side call registration device 25, the landing chair storage releasing control means 43 outputs to the landing chair movement indicating device 27 a storage releasing indication command for indicating that the seat portion 20 is displaced. That is, the landing chair storage releasing control means 43 operates the landing chair movement indicating device 27 such that the storage releasing alarm lamp 30 is lit (S14). After that, the landing chair storage releasing control means 43 outputs to the landing speaker 24*a* storage releasing notification command for generating a sound indicating that the seat portion 20 is displaced. In this example, the landing speaker 24 is thereby operated to generate a sound (make an announcement) saying "The chair is going to be ejected. Please watch out." (S15).

After that, the landing chair storage releasing control means 43 determines whether or not the obstacle detecting device 32 has detected the presence of an obstacle in a range in which the seat portion 20 is displaced (S16). When the obstacle detecting device 32 detects the presence of the obstacle, the landing chair storage releasing control means 43 outputs to the landing speaker 24 a storage releasing notification command for generating a sound indicating that the seat portion 20 is displaced. In this example, the landing speaker 24 is thereby operated to generate a sound (make an announcement) saying "The chair is going to be ejected. Please stay away from the chair elected position." (S17).

When the obstacle detecting device 32 does nor detect the presence of an obstacle, the landing chair storage releasing control means 43 outputs a storage releasing operation command to the landing chair driving device 22 such that the storage releasing operation is performed (S18). The landing chair driving device 22 is thereby operated, so the seat portion 20 is turned from the landing chair storage position to the landing chair service position.

Figure 6:
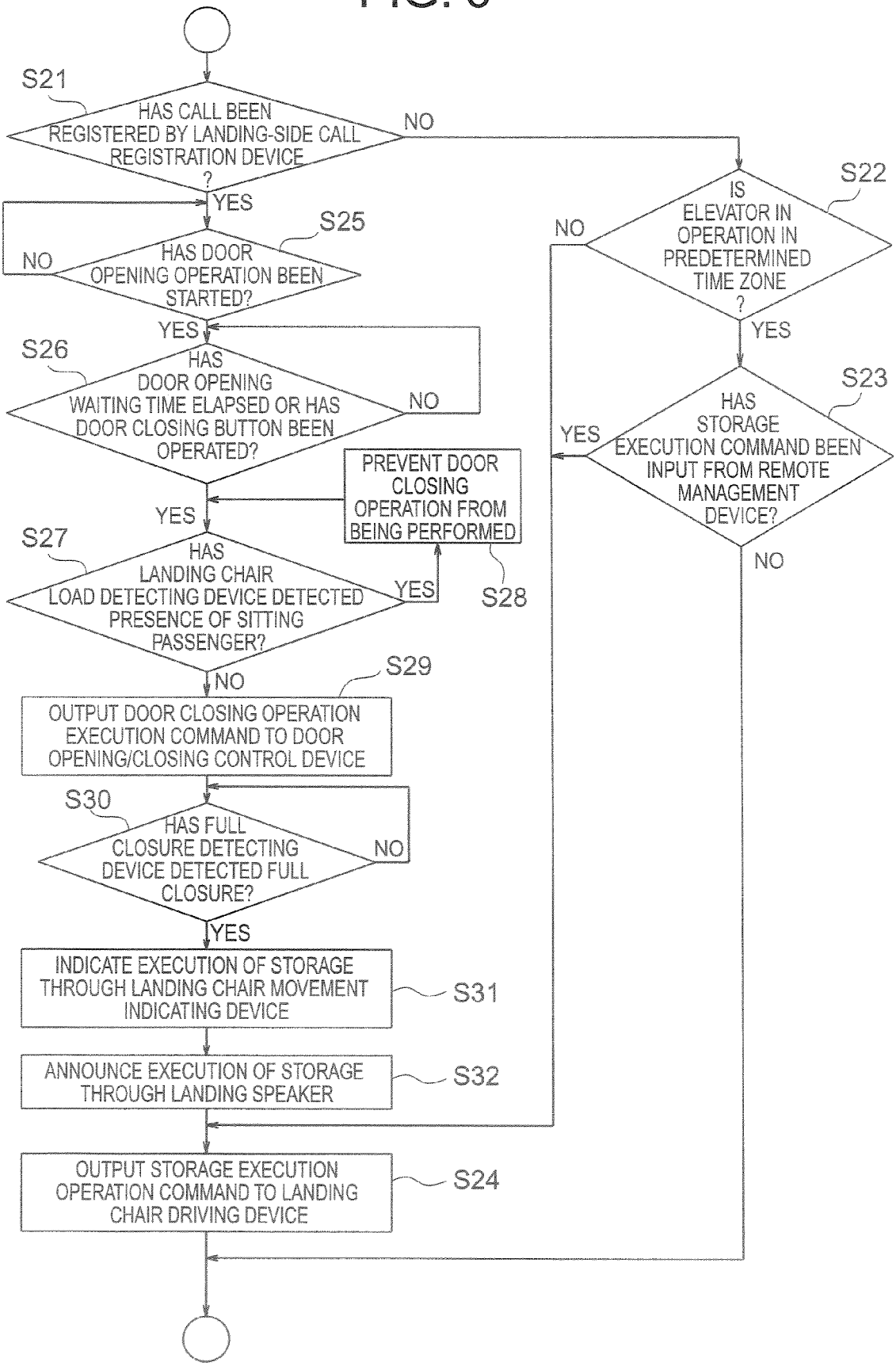
FIG. 6 is a flowchart showing the processing operations of the landing chair storage execution control means of FIG. 1.

Next, the processing operations of the landing chair storage execution control means 44 will be described. FIG. 6 is a flowchart showing the processing operations of the landing chair storage execution control means 44 of FIG. 1. As shown in the figure, the landing chair storage execution control means 44 first determines whether or not a call has been registered by the landing-side call registration device 25 (S21). When no call is registered by the landing-side call registration device 25, the landing chair storage execution control means 44 determines based on information from the clock device 38 whether or not a time zone in which the elevator is in operation corresponds to the predetermined time zone (S22). When the time zone in which the elevator is in operation does not correspond to the predetermined time zone, the landing chair storage execution control means 44 determines whether or not a storage execution command from the remote management device 39 has been input to the landing chair storage execution control means 44 (S23). When no storage execution command is input to the landing chair storage execution control means 44, the landing chair driving device 22 is not operated, thereby maintaining the seat portion 20 to be held at the service position.

When the time zone in which the elevator is in operation corresponds to the predetermined time zone or when the storage execution command from the remote management device 39 is input, the landing chair storage execution control means 44 outputs a storage execution operation command to the landing chair driving device 22 (S24). The landing chair driving device 22 is thereby operated, so the seat portion 20 is turned from the landing chair service position to the landing chair storage position.

On the other hand, when a call has been registered by the landing-side call registration device 25, the landing chair storage execution control means 44 determines based on information from the landing response door opening detecting device 37 whether or not the door opening operation of the elevator doorway has been started (S25). When the door opening operation is not started, the landing chair storage execution control means 44 repeatedly determines whether or not the door opening operation has been started.

When the door opening operation is started, the landing chair storage execution control means 44 determines whether or not a door opening waiting time at the elevator doorway has elapsed, and whether or not the door closing button 13 provided on the car operator control panel 10 has been operated (S26). When the door opening waiting time has not elapsed and the door closing button 13 has not been operated, the landing chair storage execution control means 44 repeatedly determines whether or not the door opening waiting time has elapsed, and whether or not the door closing button 13 has been operated.

In a case where the door opening waiting time has elapsed or in a case where the door closing button 13 has been operated, the landing chair storage execution control means 44 determines whether or not the landing chair load detecting device 31 has detected that there is a passenger sitting on the seat portion 20 (S27). When the landing chair load detecting device 31 has detected than there is a passenger sitting on the seat portion 20, the landing chair storage execution control means 44 outputs to the door opening/closing control device 9 a door closing operation preventing command for preventing the door closing operation of the elevator doorway from being started (S28). The elevator doorway is thereby held in a door opening waiting state. After that, the landing chair storage execution control means 44 repeatedly determines whether or not there is a passenger sitting on the seat portion 20.

When the landing chair load detecting device 31 has not detected that there is a passenger sitting on the seat portion 20, the landing chair storage execution control means 44 outputs to the door opening/closing control device 9 a door closing operation execution command for starting the door closing operation of the elevator doorway (S29). The door closing operation of the elevator-doorway is thereby started.

After that, the landing chair storage execution control means 44 determines based on information from the full closure detecting device 35 whether or not the door closing operation of the elevator doorway has been completed (S30). When the completion of the door closing operation is not detected, the landing chair storage execution control means 44 repeatedly determines whether or not the door closing operation has been completed. When the completion of the door closing operation is detected, the landing chair storage execution control means 44 outputs to the landing chair movement indicating device 27 a storage execution indication command for indicating that the seat portion 20 is displaced (S31). The storage execution alarm lamp 29 is thereby lit. The landing chair storage execution control means 44 outputs to the landing speaker 24 a storage execution notification command for acoustically notifying that the seat portion 20 is displaced (S32). The landing speaker 24 thereby makes an announcement by generating a sound saying "The chair is going to be stored. Please watch out."

After that, the landing chair storage execution control means 44 outputs a storage execution operation command to the landing chair driving device 22 (S24), so the seat portion 20 is turned from the landing chair service position to the landing chair storage position.

Figure 7:
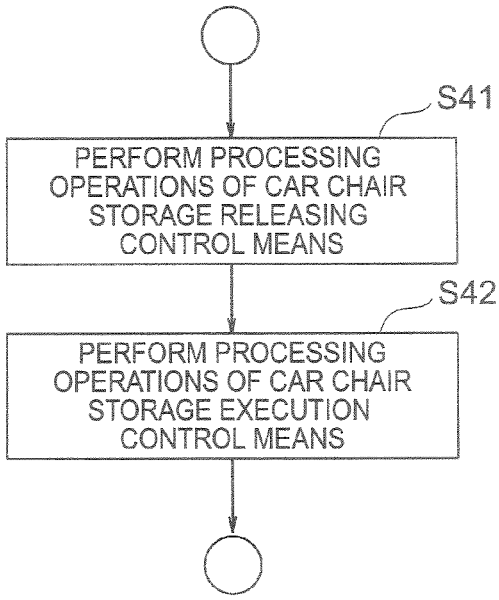
FIG. 7 is a flowchart showing the processing operations of the car chair control means of FIG. 1.

Next, the processing operations of the car chair control means 42 will be described. FIG. 7 is a flowchart showing the processing operations of the car chair control means 42 of FIG. 1. As shown in the FIG., the car chair control means 42 first performs the processing operations by the car chair storage releasing control means 45 (S41), and then performs the processing operations by the car chair storage execution control means 46 (S42).

Figure 8:
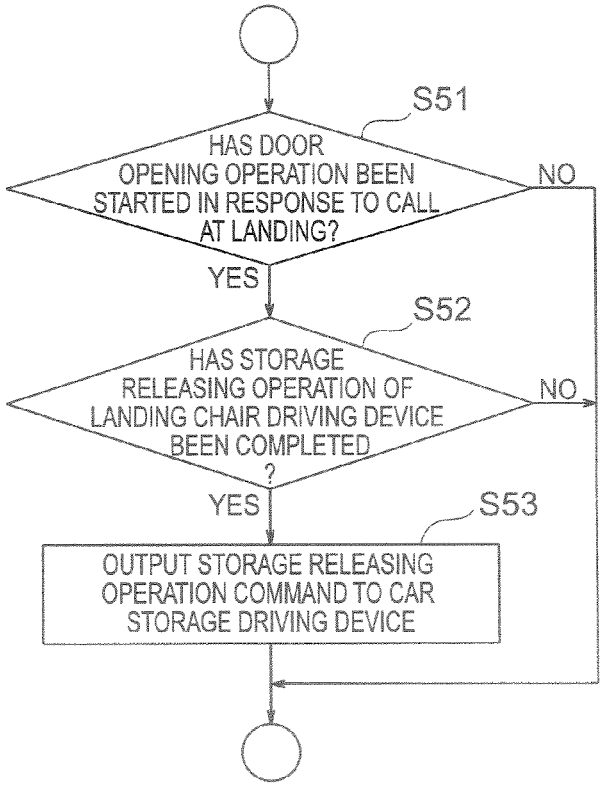
FIG. 8 is a flowchart showing the processing operations of the car chair storage releasing control means of FIG. 1.

Next, the processing operations of the car chair storage releasing control means 45 will be described. FIG. 8 is a flowchart showing the processing operations of the car chair storage releasing control means 45 of FIG. 1. As shown in the FIG., the car chair storage releasing control means 45 first determines whether or not the car 2 has responded to a call registered by the landing-side call registration device 25 and the door opening operation of the elevator doorway has been started (S51). In a case where the door opening operation has been started, the car chair storage releasing control means 45 determines based on information from the landing chair control means 41 whether or not the storage releasing operation of the landing chair driving device 22 has been completed (S52). In a case where the storage releasing operation of the landing chair driving device 22 has been completed, the car chair storage releasing control means 45 outputs a storage releasing operation command to the car chair driving device 18 (S53). The seat portion 16 of the car chair 14 is thereby turned from the car chair storage position to the car chair service position.

On the other hand, in a case where the door opening operation of the elevator has not been started or in a case where the storage releasing operation of the landing chair driving device 22 has not been completed, the car chair driving device 18 is not operated, thereby maintaining the seat portion 16 to be held at the car chair storage position.

Figure 9:
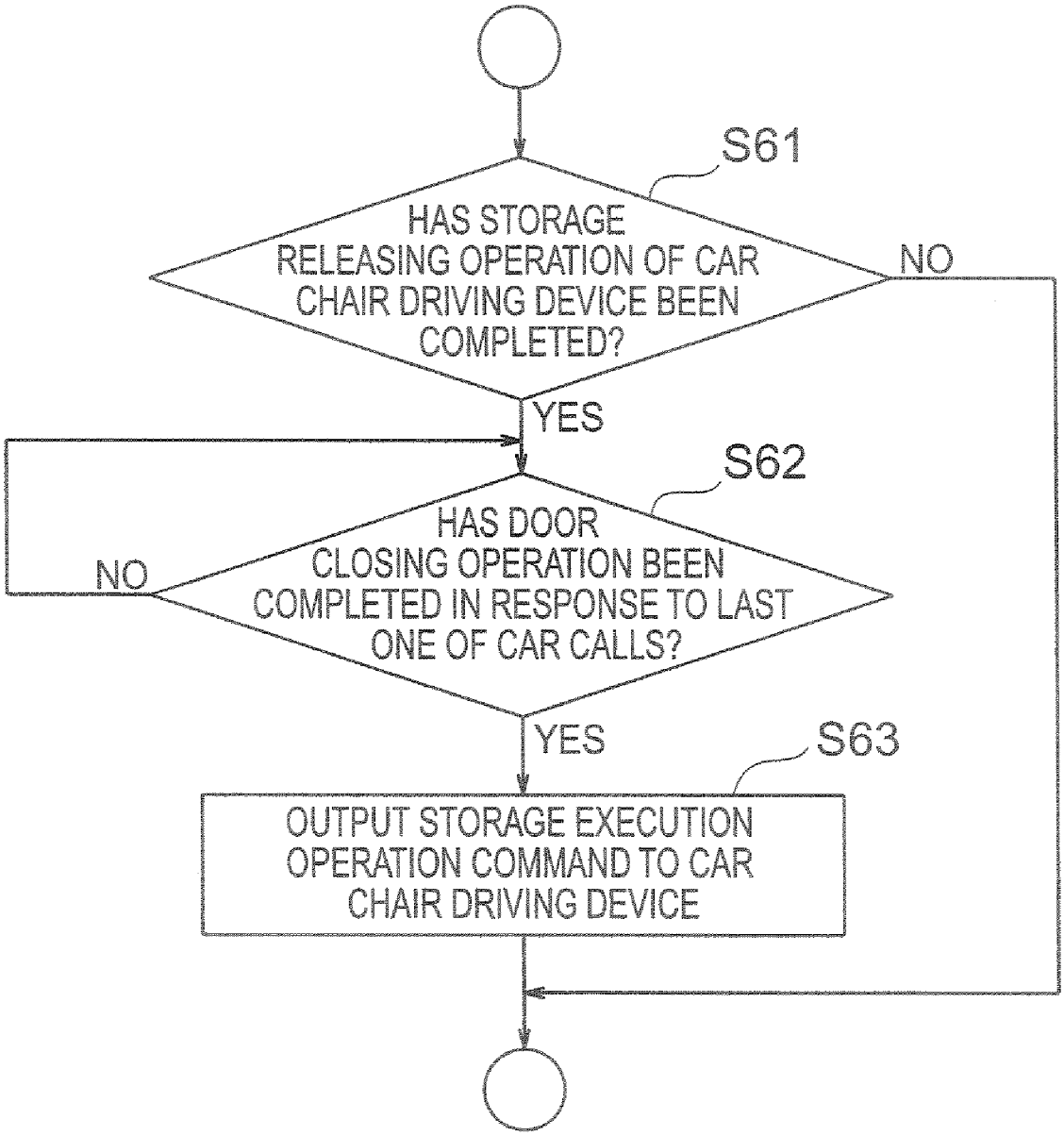
FIG. 9 is a flowchart showing the processing operations of the car chair storage execution control means of FIG. 1.

Next, the processing operations of the car chair storage execution control means 46 will be described, FIG. 9 is a flowchart showing the processing operations of the car chair storage execution control means 46 of FIG. 1. As shown in the FIG., the car chair storage execution control means 46 first determines based on information from the car chair storage releasing control means 45 whether or not the storage releasing operation of the car chair driving device 18 has been performed (S61). In a case where the storage releasing operation has not been performed, the car chair driving device 18 is not operated, thereby maintaining the seat portion 16 to be held at the car chair storage position.

In a case where the storage releasing operation of the car chair driving device 18 has been performed, the car chair storage execution control means 46 determines whether or not the car 2 has responded to all the calls registered by the car-side call registration device 11 and the door closing operation of the elevator doorway at the time of a response of the car 2 to the last one of the registered calls has been completed (S62). In a case where the door closing operation at the time of the response to the last one of the registered calls has not been completed, the car chair storage execution control means 46 makes the same determination until the door closing operation for the last one of the registered calls is completed.

In a case where the car 2 has responded to the last one of the registered calls and the door closing operation has been completed, the car chair storage execution control means 46 outputs a storage execution operation command to the car chair driving device 18 (S63). The car chair driving device 18 is thereby operated, so the seat portion 16 is turned from the car chair service position to the car chair storage position.

In the operating apparatus for the elevator constructed as described above, the control device 40 has the landing chair control means 41 for controlling the landing chair driving device 22 so as to displace the seat portion 20 between the landing chair storage position and the landing chair service position. Therefore, the seat portion 20 can be drawn out and stored at the landing 5 in accordance with the operation of the elevator. Thus, a passenger at the landing 5 can use the landing chair 19 while waiting at the landing 5. When the landing chair 19 is not required in terms of the operation of the elevator, the seat portion 20 can be stored to prevent the landing chair 19 from constituting an obstacle.

The control device 40 further has the car chair control means 42 for controlling the car chair driving device 18 such that the seat portion 16 is displaced between the car chair storage position and the car chair service position based on respective pieces of information from the landing chair control means 41 and the operation detecting means. Therefore, the seat portion 16 of the car chair 14 can be displaced in association with displacement of the seat portion 20 of the landing chair 19, and the seat portion 16 can be drawn out and stored within the car 2 as well. Thus, a passenger within the car 2 can use the car chair 14. When the car chair 14 is not required in terms of the operation of the elevator, the seat portion 16 can be stored to prevent the car chair 14 from constituting an obstacle within the car 2.

The landing chair control means 41 controls the landing chair driving device 22 such that the storage releasing operation is performed on the condition that a call has been registered by the landing-side call registration device 25, and controls the landing chair driving device 22 such that the storage execution operation is performed on the condition that the landing response door opening detecting device 37 has detected the start of the door opening operation and then the full closure detecting device 35 has detected the completion of the door closing operation. Therefore, a passenger can use the landing chair 19 while waiting at the landing 5. After the passenger at the landing 5 has moved into the car 2, the seat portion 20 of the landing chair 19 can be stored so as not to constitute an obstacle at the landing 5.

The seat portion 20 of the landing chair 19 is provided with the landing chair load detecting device 31 for detecting whether or not there is a passenger sitting on the seat portion 20. Therefore, when the passenger remains on the seat portion 20 and does not move into the car 2 even after the completion of the door opening operation, the door open state can be maintained. Thus, the passenger is allowed to get on the car 2 more securely even when he or she takes some time in moving into the car 2 as in the case of, for example, an elderly person.

The car chair control means 42 controls the car chair driving device 18 such that the storage releasing operation is performed on the condition that the storage releasing operation of the landing chair driving device 22 has been completed, the car 2 has responded to a call registered by the landing-side call registration device 25, and the door opening operation of the elevator doorway has been started. The car chair control means 42 controls the car chair driving device 18 such that the storage execution operation is performed on the condition that the car 2 has responded to a call registered by the car-side call registration device 11 and the door closing operation of the elevator doorway has been completed. Therefore, the car chair 14 can be made available when a passenger sitting on the landing chair 19 moves into the car 2. Further, the car chair 14 can be stored when the car 2 reaches a destination floor designated by the passenger within the car 2 and a service at the destination floor is terminated.

The control device 40 notifies through the landing speaker 24 and the landing chair movement indicating device 27 that the seat portion 20 is displaced, when the landing chair driving device 22 performs a service releasing operation and the storage execution operation respectively. Therefore, it is possible to urge a passenger to pay attention, and the seat portion 20 can be prevented from coming into contact with the passenger during displacement.

The landing 5 is provided with the obstacle detecting device 32 for detecting whether or not there is an obstacle in the range in which the seat portion 20 is displaced. Therefore, the seat portion 20 can be prevented from being damaged through a collision with the obstacle.

The control device 40 controls the landing chair driving device 22 such that the storage releasing operation is prevented from being started when the time zone in which the elevator is in operation turns out to be the predetermined time zone based on information from the clock device 38. Therefore, the seat portion 20 can be forcibly stored in a time zone in which many people use the elevator, for example, in a clock-in time zone or a clock-out time zone. The seat portion 20 can thereby be prevented from constituting an obstacle to a passenger passing through the landing 5.

The landing chair control means 41 controls the landing chair driving device 22 based on information from the remote management device 39 for remotely managing the operation of the elevator. Therefore, the seat portion 20 can also be displaced through remote control.

In the foregoing example, the storage releasing operation of the landing chair driving device 22 is performed on the condition that a call has been registered by the landing-side call registration device 25. However, it is also appropriate to provide the landing operator control panel 23 with a landing chair service request button separately from the landing-side call registration device 25, and operate the landing chair service request button to ensure the storage releasing operation of the landing chair driving device 22. In the case where the landing operator control panel 23 is provided with the landing chair service request button, a call for the car 2 may also be registered through operation of the landing chair service request button. In addition, the storage releasing operation of the landing chair driving device 22 may be performed through control of the landing chair storage releasing control means 43 on the condition that a predetermined operation (e.g., double clip) has been performed for the landing operational buttons 28 (i.e., a block sign has been registered). In this manner, the seat portion 20 can be displaced to the landing chair service position only when a passenger desires to use the landing chair 19.

While the single landing chair 19 is installed at each landing 5 per elevator in the foregoing example, two or more landing chairs 19 may be installed per elevator. While the single elevator is provided in the foregoing example, a plurality of elevators may be provided.

In the foregoing example, a series of operations of releasing the seat portion 20 from being held at the landing chair storage position and displacing the seat portion 20 from the landing chair storage position to the landing chair service position are defined as the storage releasing operation of the landing chair driving device 22. However, only the operation of releasing the seat portion 20 from being held at the landing chair storage position may be defined as the storage releasing operation. In this case, when the storage releasing operation of the landing chair driving device 22 is completed, the landing speaker 24 provides users with a guidance (announcement) to notify them that they can manually draw out the seat portion 20 and use the landing chair 19.

In the foregoing example, the landing chair control means 41 determines based on information from the landing chair load detecting device 31 whether or not the door closing operation of the elevator doorway can be started. However, the landing chair control means 41 may determine based on information from the landing chair load detecting device 31 whether or not the storage execution operation of the landing chair driving device 22 can be started. In this case, when the landing chair load detecting device 31 detects that there is a passenger sitting on the seat portion 20, the landing chair control means 41 controls the landing chair load detecting device 31 such that the storage execution operation is prevented from being started.

In the foregoing example, when the car 2 responds to a call registered by the landing-side call registration device 25 and the door closing operation of the elevator doorway is completed, the storage execution operation of the landing chair driving device 22 is performed. However, the pair of the landing operational buttons 28 indicating a vertical direction may both be operated, so the storage execution operation of the landing chair driving device 22 may be prevented from being started until the car 2 responds to calls registered through operation of all (two) the landing operational buttons 28 and the door closing operation is completed.

In the foregoing example, the storage execution operation of the car chair driving device 18 is not performed until the car 2 responds to all the calls registered by the car-side call registration device 11 and the door closing operation of the elevator doorway for the last one of the registered calls has been completed. However, the storage execution operation of the car chair driving device 18 may be performed every time the car 2 responds to each call registered by the car-side call registration device 11 and the door closing operation of the elevator doorway is completed.

In the foregoing example, a passenger within the car 2 is not notified that the seat portion 16 of the car chair 14 is displaced. However, an in-car speaker and a car chair movement indicating device may be provided within the car 2 to notify the passenger within the car 2 that the seat portion 16 is displaced. In this case, when the seat portion 16 of the car chair 14 is displaced, the car chair movement indicating device indicates displacement of the seat portion 16, and the in-car speaker issues a sound indicating displacement of the seat portion 16, in this manner, it is possible to urge the passenger within the car 2 to pay attention, so the seat portion 16 can be prevented from coming into contact with the passenger.

In the foregoing example, it is not detected whether or not there is a passenger sitting on the seat portion 16 of the car chair 14. However, the seat portion 16 may be provided with a car chair load detecting device for detecting whether or not there is a passenger sitting on the seat portion 16. In this case, when the car 2 responds to a call registered by the car-side call registration device 11, the door opening operation of the elevator doorway is completed, and the car chair load detecting device detects that there is a passenger sitting on the seat portion 16, the car chair control means 42 controls the operation of the elevator such that the door closing operation of the elevator doorway is prevented from being started. When the car chair load detecting device detects that there is a passenger sitting on the seat portion 16, the car chair control means 42 controls the car chair driving device 18 such that the storage execution operation is prevented from being started. In this manner, even when a passenger takes some time in moving as in the case of, for example, an elderly person or the like, he or she is allowed to move more securely from the Inside of the car 2 to the landing 5. Further, the storage execution operation of the car chair driving device 18 can be prevented from being performed despite the presence of a sitting passenger.

In the foregoing example, the obstacle detecting device 32 is provided only at the landing 5. However, an obstacle detecting device may also be provided within the car 2. In this case, when the obstacle detecting device has detected that there is an obstacle within a range in which the seat portion 16 of the car chair 14 is displaced, the car chair control means 42 performs control to prevent the storage releasing operation of the car chair driving device 18 from being started. In this manner, the car chair 14 as well as the landing chair 19 can be prevented from being damaged.

In the foregoing example, it is not detected whether or not the seat portion 20 has actually been displaced. However, the landing chair driving device 22 or the seat portion 20 may be provided with an operation completion detecting device for detecting whether or not at least one of the storage releasing operation and the storage execution operation has been completed. In this case, when the operation completion detecting device has not detected the completion of the storage releasing operation or the storage execution operation even after a predetermined time has elapsed, the landing speaker 24 and the landing chair movement indicating device 27 provide a guidance (announcement) indicating that the seat portion 20 cannot be displaced.

In the foregoing example, it is not detected whether or not the seat portion 16 has actually been displaced. However, the car chair driving device 18 or the seat portion 16 may be provided with an operation completion detecting device for detecting whether or not at least one of the storage releasing operation and the storage execution operation has been completed. In this case, when the operation completion detecting device has not detected the completion of the storage releasing operation or the storage execution operation even after a predetermined time has elapsed, the in-car speaker and the car chair movement indicating device provide a guidance (announcement) indicating that the seat portion 16 cannot be displaced.

In the foregoing example, when the time zone in which the elevator is in operation is the predetermined time zone, the storage releasing operation of only the landing chair driving device 22 is prevented from being started. However, the storage releasing operation of the car chair driving device 18 may also be prevented from being started in the predetermined time zone. In this manner, the car chair 14 can be prevented from constituting an obstacle within the car 2 during, for example, rush hours or the like.

In the foregoing example, only the predetermined time zone for preventing the storage releasing operation of the landing chair driving device 22 from being started is set in the clock device 38. However, a time zone for preventing the storage execution operation of the landing chair driving device 22 from being started may also be set in the clock device 38. In other words, a first set time zone and a second set time zone may be set in the clock device 38, and the landing chair control means 41 may control the landing chair driving device 22 such that the storage execution operation is performed when the time zone in which the elevator is in operation is the first set time zone, and control the landing chair driving device 22 such that the storage releasing operation is performed when the time zone in which the elevator is in operation is the second set time zone. As a result, the movement of the landing chair 19 can be managed according to each of the time zones.

The invention claimed is:

1. An operating apparatus for an elevator, comprising:

a landing chair provided at a landing and having a seat portion displaceable between a landing chair storage position and a landing chair service position allowing a passenger to sit;

a landing chair displacement device for performing a storage execution operation of displacing the seat portion from the landing chair service position to the landing chair storage position to hold the seat portion at the landing chair storage position, and a storage releasing operation of releasing the seat portion from being held at the landing chair storage position; and a control device having landing chair control means for controlling the landing chair displacement device based on information from operation detecting means for detecting an operational state of the elevator.

2. The operating apparatus for the elevator according to claim 1, wherein the operating apparatus for the elevator further comprises:

a car chair provided within a car and having a seat portion displaceable between a car chair storage position and a car chair service position allowing a passenger to sit; and a car chair displacement device for performing a storage execution operation of displacing the seat portion from the car chair service position to the car chair storage position to hold the seat portion at the car chair storage position and a storage releasing operation of releasing the seat portion from being held at the car chair storage position, and in that the control device further has car chair control means for controlling the car chair displacement device based on respective pieces of information from the landing chair control means and the operation detecting means.

3. The operating apparatus for the elevator according to claim 1, wherein:

the operation detecting means has a landing-side call registration device for registering a call at the landing, a landing response door opening detecting device for detecting whether or not the car has responded to a call registered by the landing-side call registration device and a door opening operation of an elevator doorway has been started, and a full closure detecting device for detecting whether or not a door closing operation of the elevator doorway has been completed; and the landing chair control means controls the landing chair displacement device such that the landing chair displacement device performs the storage releasing operation on a condition that the call has been registered by the landing-side call registration device, and controls the landing chair displacement device such that the landing chair displacement device performs the storage execution operation on a condition that the landing response door opening detecting device has detected start of the door opening operation and then the full closure detecting device has detected completion of the door closing operation.

4. The operating apparatus for the elevator according to claim 3, wherein the operating apparatus for the elevator further comprises:

a landing chair load detecting device for detecting whether or not a passenger sits on the seat portion of the landing chair, and in that the landing chair control means controls operation of the elevator such that the door closing operation of the elevator doorway is prevented from being started when the car responds to the call registered by the landing-side call registration device, the door opening operation of the elevator doorway is completed, and the landing chair load detecting device detects that the passenger sits on the seat portion.

5. The operating apparatus for the elevator according to claim 3, wherein:

the operation detecting means further has a car-side call registration device for registering a call within the car; and the car chair control means controls the car chair displacement device such that the car chair displacement device performs the storage releasing operation on a condition that the storage releasing operation of the landing chair displacement device has been completed, the car has responded to the call registered by the landing-side call registration device, and the door opening operation of the elevator doorway has been started, and controls the car chair displacement device such that the car chair displacement device performs the storage execution operation on a condition that the car has responded to the call registered by the car-side call registration device and the door closing operation of the elevator doorway has been completed.

6. The operating apparatus for the elevator according to claim 5, wherein the operating apparatus for the elevator further comprises:

a car chair load detecting device for detecting whether or not a passenger sits on the seat portion of the car chair, and in that the car chair control means controls operation of the elevator such that the door closing operation of the elevator doorway is prevented from being started when the car responds to the call registered by the car-side call registration device, the door opening operation of the elevator doorway is completed, and the car chair load detecting device detects that the passenger sits on the seat portion.

7. The operating apparatus for the elevator according to claim 1, wherein the operating apparatus for the elevator further comprises a notification device, and in that the control device notifies through the notification device that the seat portion is displaced when the storage execution operation is performed and when the storage releasing operation is performed.

8. The operating apparatus for the elevator according to claim 1, wherein the operating apparatus for the elevator further comprises an obstacle detecting device for detecting whether or not an obstacle exists in a range in which the seat portion is displaced, and in that the control device performs control to prevent the storage releasing operation from being started when the obstacle detecting device detects the obstacle.

9. The operating apparatus for the elevator according to claim 1, wherein the operating apparatus for the elevator further comprises a clock device in which a predetermined time zone is set, and in that the control device performs control to prevent the storage releasing operation from being started when a time zone in which the elevator is in operation is the predetermined time zone.

10. An operating apparatus for an elevator, comprising:

a landing chair provided at a landing and having a seat portion displaceable between a landing chair storage position and a landing chair service position allowing a passenger to sit;

a landing chair displacement device for performing a storage execution operation of displacing the seat portion from the landing chair service position to the landing chair storage position to hold the seat portion at the landing chair storage position, and a storage releasing operation of releasing the seat portion from being held at the landing chair storage position;

a clock device in which a first set time zone and a second set time zone are set respectively; and a control device having landing chair control means for controlling the landing chair displacement device such that the landing chair displacement device performs the storage execution operation when a time zone in which the elevator is in operation is the first set time zone, and controlling the landing chair displacement device such that the landing chair displacement device performs the storage releasing operation when the time zone in which the elevator is in operation is the second set time zone.

11. An operating apparatus for an elevator, comprising:

a landing chair provided at a landing and having a seat portion displaceable between a landing chair storage position and a landing chair service position allowing a passenger to sit;

a landing chair displacement device for performing a storage execution operation of displacing the seat portion from the landing chair service position to the landing chair storage position to hold the seat portion at the landing chair storage position, and a storage releasing operation of releasing the seat portion from being held at the landing chair storage position;

a remote management device for remotely managing operation of the elevator; and a control device having landing chair control means for controlling the landing chair displacement device based on information from the remote management device.

12. The operating apparatus for the elevator according to claim 2, wherein:

the operation detecting means has a landing-side call registration device for registering a call at the landing, a landing response door opening detecting device for detecting whether or not the car has responded to a call registered by the landing-side call registration device and a door opening operation of an elevator doorway has been started, and a full closure detecting device for detecting whether or not a door closing operation of the elevator doorway has been completed; and the landing chair control means controls the landing chair displacement device such that the landing chair displacement device performs the storage releasing operation on a condition that the call has been registered by the landing-side call registration device, and controls the landing chair displacement device such that the landing chair displacement device performs the storage execution operation on a condition that the landing response door opening detecting device has detected start of the door opening operation and then the full closure detecting device has detected completion of the door closing operation.

13. The operating apparatus for the elevator according to claim 12, wherein the operating apparatus for the elevator further comprises:

a landing chair load detecting device for detecting whether or not a passenger sits on the seat portion of the landing chair, and in that the landing chair control means controls operation of the elevator such that the door closing operation of the elevator doorway is prevented from being started when the car responds to the call registered by the landing-side call registration device, the door opening operation of the elevator doorway is completed, and the landing chair load detecting device detects that the passenger sits on the seat portion.

14. The operating apparatus for the elevator according to claim 12, wherein:

the operation detecting means further has a car-side call registration device for registering a call within the car; and the car chair control means controls the car chair displacement device such that the car chair displacement device performs the storage releasing operation on a condition that the storage releasing operation of the landing chair displacement device has been completed, the car has responded to the call registered by the landing-side call registration device, and the door opening operation of the elevator doorway has been started, and controls the car chair displacement device such that the car chair displacement device performs the storage execution operation on a condition that the car has responded to the call registered by the car-side call registration device and the door closing operation of the elevator doorway has been completed.

15. The operating apparatus for the elevator according to claim 14, wherein the operating apparatus for the elevator further comprises:

a car chair load detecting device for detecting whether or not a passenger sits on the seat portion of the car chair, and in that the car chair control means controls operation of the elevator such that the door closing operation of the elevator doorway is prevented from being started when the car responds to the call registered by the car-side call registration device, the door opening operation of the elevator doorway is completed, and the car chair load detecting device detects that the passenger sits on the seat portion.

* * * * *